US007742028B2

(12) United States Patent
Nitta et al.

(10) Patent No.: US 7,742,028 B2
(45) Date of Patent: Jun. 22, 2010

(54) DISPLAY CONTROL APPARATUS AND METHOD

(75) Inventors: Takashi Nitta, Chino (JP); Junichi Nakamura, Shiojiri (JP); Shoichi Uchiyama, Shimossuna-machi (JP); Tsunemori Asahi, Hotaka-machi (JP)

(73) Assignee: Seiko Epson Corporation, Tokyo (JP)

( * ) Notice: Subject to any disclaimer, the term of this patent is extended or adjusted under 35 U.S.C. 154(b) by 838 days.

(21) Appl. No.: 11/234,209

(22) Filed: Sep. 26, 2005

(65) Prior Publication Data

US 2006/0066547 A1 Mar. 30, 2006

(30) Foreign Application Priority Data

Sep. 29, 2004 (JP) ..... 2004-284005

(51) Int. Cl.
*G09G 3/36* (2006.01)

(52) U.S. Cl. ..... 345/88; 349/8; 349/192; 348/744

(58) Field of Classification Search ..... 345/87–100; 349/5, 8, 192; 348/744, 758
See application file for complete search history.

(56) References Cited

U.S. PATENT DOCUMENTS

| | | | | |
|---|---|---|---|---|
| 5,978,142 | A | 11/1999 | Blackham et al. | |
| 6,359,662 | B1 * | 3/2002 | Walker | 348/743 |
| 6,618,115 | B1 * | 9/2003 | Hiroki | 349/192 |
| 6,985,272 | B2 * | 1/2006 | Bridgwater et al. | 359/237 |
| 7,053,976 | B2 | 5/2006 | Hiroki | |
| 2006/0176935 | A1 | 8/2006 | Hiroki | |

FOREIGN PATENT DOCUMENTS

| | | |
|---|---|---|
| JP | A-4-81714 | 3/1992 |
| JP | A-6-167690 | 6/1994 |
| JP | A-2001-21861 | 1/2001 |
| JP | A-2001-222265 | 8/2001 |
| JP | A 2003-316330 | 11/2003 |

* cited by examiner

*Primary Examiner*—Sumati Lefkowitz
*Assistant Examiner*—Seokyun Moon
(74) *Attorney, Agent, or Firm*—Oliff & Berridge, PLC

(57) ABSTRACT

A display control apparatus that controls first and second modulation sections optically connected in series includes a storage unit and a control unit. The storage unit stores information to specify a defective pixel of the first modulation section. The control unit controls the second modulation section in response to a defect of the defective pixel being stored in the storage unit.

11 Claims, 17 Drawing Sheets

A DEFECTIVE PIXEL IS A PIXEL THAT IS DIFFERENT FROM A NORMAL PIXEL IN VOLTAGE-TRANSMITTANCE CURVE.

IN NORMALLY BLACK MODE

DISPLAY CONTROL APPARATUS AND METHOD

This application claims the benefit of Japanese Patent Application No. 2004-284005 filed Sep. 29, 2004. The entire disclosure of the prior application is hereby incorporated by reference herein in its entirety.

BACKGROUND

The exemplary embodiments relate to a display control apparatus and method that is suitable for use in performing a correction process to a defective pixel of a display panel in a display device using two modulation systems, such as, for example, an HDR (High Dynamic Range) display.

Defective pixels resulting from variations in manufacturing conditions, etc. sometimes occur in a liquid crystal light valve, etc. that use a high-temperature polysilicon TFT (Thin Film Transistor). Such products are determined to be defective even when the luminance difference of the defective pixels with respect to normal pixels is on the order of several percent, which provides one of the causes of a reduction in yield.

To remedy those defective pixels, a proposal to be described below has been made in this field. In a related art patent entitled "Picture Signal Processing Apparatus, Picture Signal Processing Method, and Display Device" (JP-A-2003-316330), a defective pixel is corrected such that a γ (gamma) curve thereof is selected to be uniform in a display result with that of a normal pixel. However, in this method, it is difficult to match the defective pixel with the normal pixel in the display result throughout all gradation values.

Furthermore, in a black display, for example, the defect is corrected by applying to the defective pixel a higher voltage than a normal applied voltage. To perform this process, however, a mechanism for applying a higher voltage than normal is required in terms of hardware, thus resulting in an increase in cost of the display control apparatus.

SUMMARY

The exemplary embodiments provide a display control apparatus and method whose configuration can be made with ease, simplicity, and good accuracy in order to correct or improve a defective pixel in a double-modulation system display device that performs an image display using a plurality of modulation systems optically disposed in series.

According to a first exemplary embodiment, there is provided a display control apparatus that controls first and second modulation sections optically connected in series, comprising: a storage unit that stores information to specify a defective pixel of the first modulation section; and a control unit that controls the second modulation section in response to a defect of the defective pixel being stored in the storage unit. According to this configuration, the characteristic of the defective pixel of the first modulation section can be corrected by making an adjustment using a wider amount of adjustment of a non-defective pixel of the second modulation panel section, thus enabling a high-precision defect correction. Here, as a combination of the first and second modulation panel sections, there are a combination of a panel that performs color modulation (hereinafter called a color panel) and the color panel, a combination of a panel that performs luminance modulation (hereinafter called a luminance panel) and the color panel, a combination of the color panel and the luminance panel, etc. Further, the configuration of 1 LCD or 3 LCD can be considered for each combination.

Further, the control unit may control a pixel in response to the defect, the second modulation section having the pixel at a position corresponding to the defective pixel being stored in the storage unit. Furthermore, the first modulation section includes three panels respectively corresponding to different colors. In this case, the control unit controls a pixel in response to the defect, which the second modulation section has at a position corresponding to the defective pixel being stored in the storage unit. The control unit also controls pixels in response to the defect, two out of three panels of the first modulation section not having the defective pixel and having the pixels at positions corresponding to the defective pixel. According to these configurations, a high-precision correction becomes possible even in the color panel of 3-LCD configuration.

Furthermore, when the first and second modulation sections have different resolutions from each other, the control unit controls a plurality of pixels in response to the defect, the second modulation section having the plurality of pixels at a position corresponding to the defective pixel being stored in the storage unit. According to this configuration, a high-precision correction is possible even when the two panels have different resolutions from each other.

Moreover, when the first and second modulation panel sections have different resolutions from each other, the control unit controls a pixel in response to the defect, the second modulation section having the pixel at a position corresponding to the defective pixel being stored in the storage unit and at positions adjacent to the corresponding position. The control unit also controls pixels in response to the defect, the first modulation section having the pixels at positions of the defective pixel panel adjacent to the defective pixel. According to this configuration, a high-precision correction becomes possible even when the two panels have different resolutions from each other.

Still further, the control unit varying the amount of control responsive to the defective pixel step by step in response to the positional relationship between the defective pixel and the plurality of pixels to control a plurality of pixels which the second modulation section has at a position corresponding to the defective pixel being stored in the storage unit and at positions adjacent to the corresponding position. According to this configuration, a high-precision correction is possible even when a resolution relationship is complicated.

Still further, the control unit performs pixel control responsive to the defect by modifying a gamma setting. According to this configuration, the effects of performing a high speed process and facilitating a hardware process can be obtained.

Furthermore, the control unit performs pixel control responsive to the defect upon input of a pixel value adjusted in response to the information stored in the storage unit. According to this configuration, it is possible to obtain the effects of minimal hardware modification (only a software modification may be made), low cost, and a high degree of freedom.

Still further, according to a second aspect of the exemplary embodiments, a display control method of controlling first and second modulation panel sections optically connected in series includes using a storage unit that stores information to specify a defective pixel of the first modulation panel section; and controlling the second modulation panel section in response to the defect of the defective pixel being stored in the storage unit.

BRIEF DESCRIPTION OF THE DRAWINGS

The exemplary embodiments will be described with reference to the accompanying drawings, wherein like numbers reference like elements, and wherein.

DETAILED DESCRIPTION OF EMBODIMENTS

Figure 1:
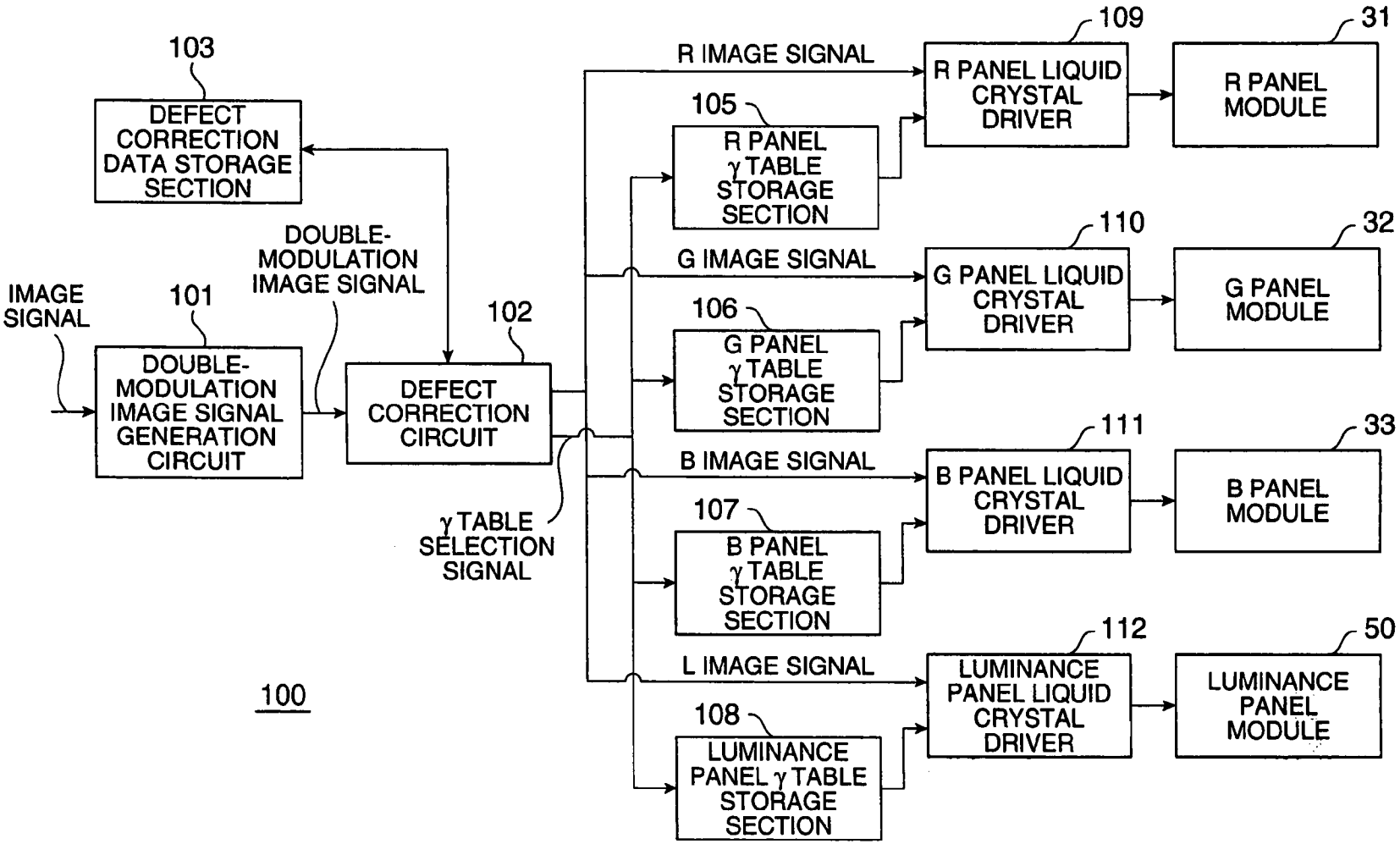
FIG. 1 is a schematic of an exemplary embodiment of the invention.
Figure 2:
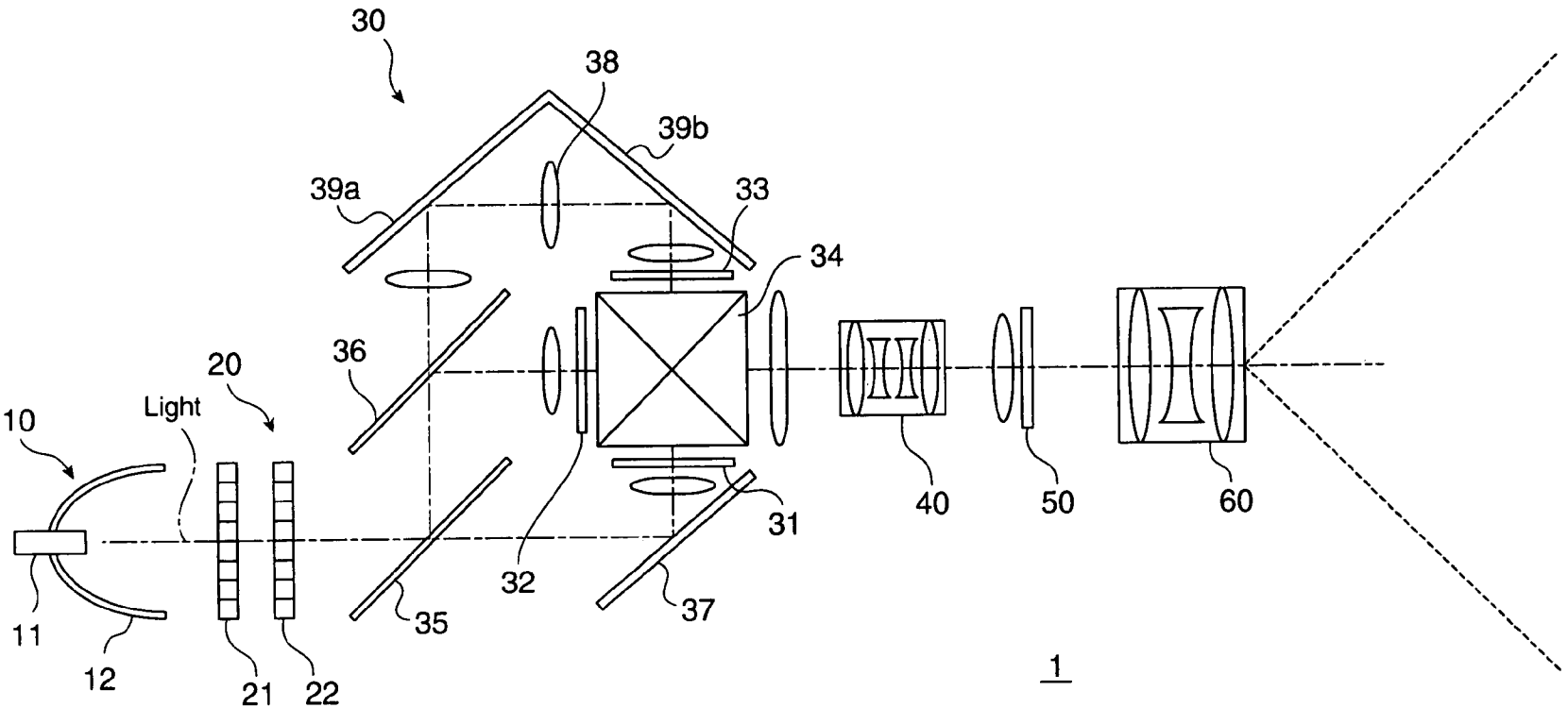
FIG. 2 is a schematic illustrating a configuration of a display device including an R panel module, etc. of FIG. 1.

FIG. 1 is a schematic of an exemplary embodiment of a display control apparatus 100. FIG. 2 is a schematic example of the optical system of a display device controlled by the display control apparatus 100 of FIG. 1. An R (Red) panel module 31, a G (Green) panel module 32, a B (blue) panel module, and a luminance panel module 50 are common in FIGS. 1 and 2.

FIG. 2 illustrates a projection type display device. The projection type display device 1 includes a light source 10, a uniform illumination unit 20, a color modulation section 30, a relay lens 40, the luminance panel module 50, and a projection lens 60. The uniform illumination unit 20 provides uniform luminance distribution of light incident from the light source 10. The color modulation section 30 modulates the luminances of three primary colors (R, G, and B) from the incident light of the uniform illumination unit 20. The relay lens 40 relays the light incident from the color modulation section 30. The luminance panel module 50 modules the luminances of all wavelength ranges of the light incident from the relay lens 40. And, the projection lens 60 projects the light incident from the luminance panel module 50 onto a screen (not shown).

The light source 10 includes a lamp 11, such as a high pressure mercury-vapor lamp, and a reflector 12 that reflects an emergent light from the lamp 11. A luminous flux emitted from the light source 10 is made uniform in the uniform illumination unit 20 where a first "fly's eye" lens 21, a second "fly's eye" lens 22, etc. are disposed in sequence.

The uniformly polarized light emerging from the uniform illumination unit 20 enters the color modulation section 30 and is separated into the three primary colors (R, G, and B). And, the three primary colors separated from each other are modulated by the R panel module 31, G panel module 32, and B panel module 33 that modulate their color components, respectively. The modulated three primary colors (R, G, and B) are combined by a cross dichroic prism 34, and the combined colors emerge therefrom and fall on the relay lens 40. A dichroic mirror 35 transmits an R component light and a dichroic mirror 36 transmits a B component light. Further, the R panel module 31 is provided with a reflecting mirror 37, and the B panel module 33 is provided with a relay lens 38 and two reflecting mirrors 39*a* and 39*b*.

The modulated light emerging from the relay lens 40 is incident further downstream on the luminance panel module 50 and is subjected to second modulation. The luminance panel module 50 modulates the luminances of all wavelength ranges of the incident light. The modulated light emerges from the luminance panel module 50, falls on the projection lens 60, and then is projected by the projection lens 60 onto the screen (not-shown). Thus, a projected image is formed such that optical modulation elements (the luminance panel module 50, R panel module 31, G panel module 32, and B panel module 33), disposed optically in series, perform pixel-by-pixel modulation. That is, the projection type display device 1 shown in FIG. 2 is obtained by optically connecting two modulation systems in series, and a plurality of relay lenses provide an optical connection between these two modulation systems. Further, the R panel module 31, G panel module 32, and B panel module 33 of the upstream stage are each configured of, for example, a 3-LCD high-temperature polysilicon TFT liquid crystal color panel. However, the luminance panel module 50 of the downstream stage is configured of, for example, a 1-LCD high-temperature polysilicon TFT liquid crystal luminance panel.

In the display control apparatus 100 of FIG. 1, based on an image signal that is externally supplied, a double-modulation image signal generation circuit 101 generates a double-modulation image signal corresponding to each of the modulation systems. The generated double-modulation image signal is inputted to a defect correction circuit 102 and is corrected based on storage data of a defect correction data storage section 103. The defect correction data storage section 103 is a nonvolatile memory storing the following data. That is, when a defective pixel exists in the R panel module 31, G panel module 32, B panel module 33, or luminance panel module 50, the data specifies the position and defect content of the defective pixel. The defect correction circuit 102 outputs image signals and a selection signal based on the data being stored in the defect correction data storage section 103. The image signals have adjusted control values of the pixels of the other panels which correspond to a defective pixel of each panel. And, the selection signal is to select a γ correction table for each panel.

The R image signal, G image signal, and B image signal outputted from the defect correction circuit 102 are inputted to an R panel liquid crystal driver 109, a G panel liquid crystal driver 110, and a B panel liquid crystal driver 111, respectively. The L image signal (luminance image signal) outputted from the defect correction circuit 102 is inputted to a luminance panel liquid crystal driver 112. Based on the γ table selection signal outputted from the defect correction circuit 102, an R panel γ table storage section 105, a B panel γ table storage section 106, a G panel γ table storage section 107, and a luminance panel γ table storage section 108 each select any one of plural γ tables being stored in each of the storage sections. Based on the inputted image signals and the selected panel γ tables, the panel liquid crystal drivers 109 to 112 control the panel modules 31 to 33 and 50, respectively.

Figure 3:
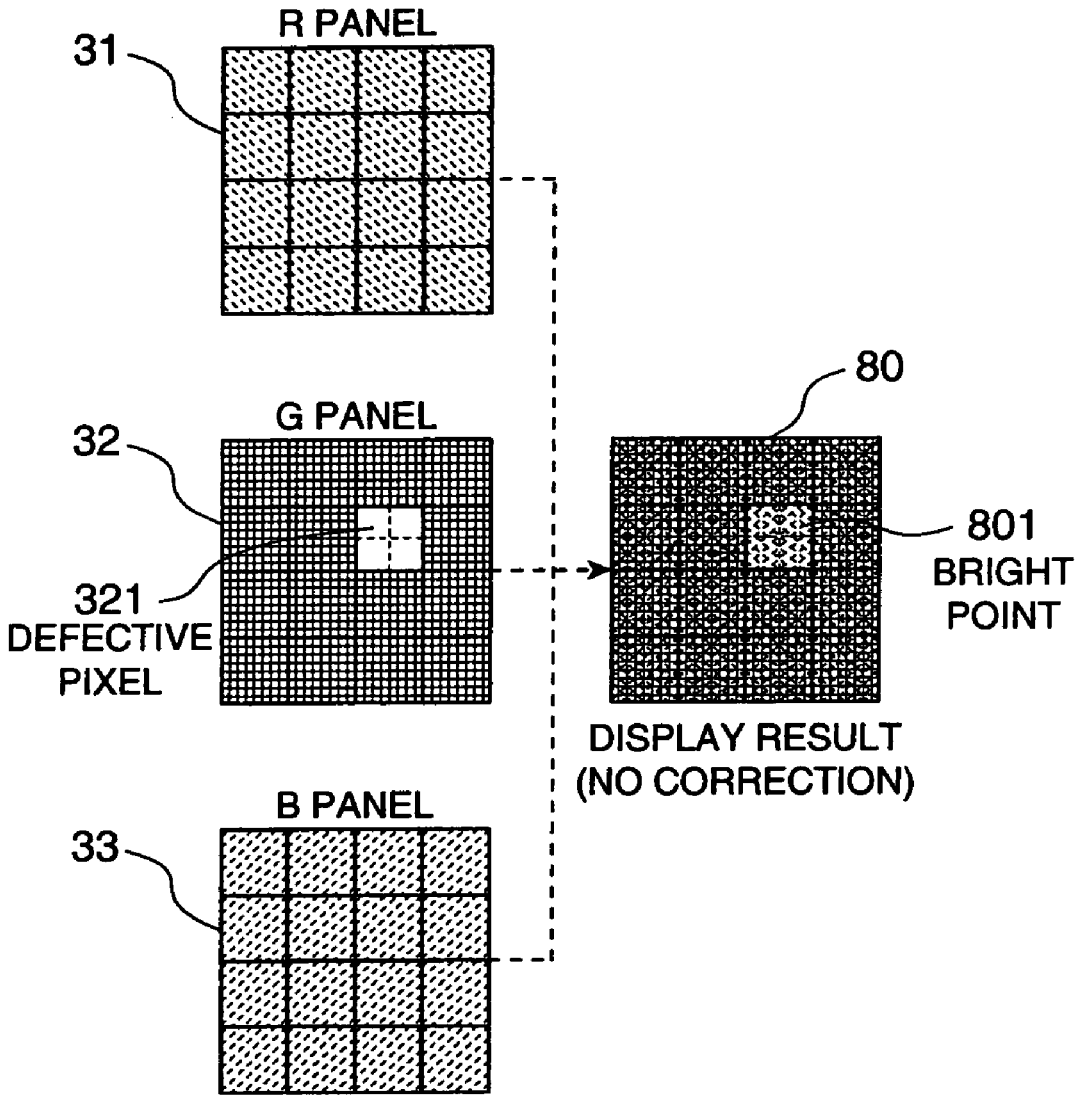
FIG. 3 is a schematic of a defective pixel and a normal pixel in an exemplary embodiment of the invention.

An example of a process performed by the display control apparatus 100 of FIG. 1 will now be described with reference to FIGS. 3 to 5. FIG. 3 shows a display example of when no correction is made when a defective pixel 321 exists in the G panel module 32. In this case, assume that the pixel 321 of the G panel module 32 shown in FIG. 3 is a defective pixel that is displayed a few percentage points brighter than the surrounding pixels. In this case, in a display result 80 obtained when no correction is made, a normal pixel portion is displayed in dark gray, whereas a bright green point is displayed at a spot 801 where the defective pixel exists.

Figure 4:
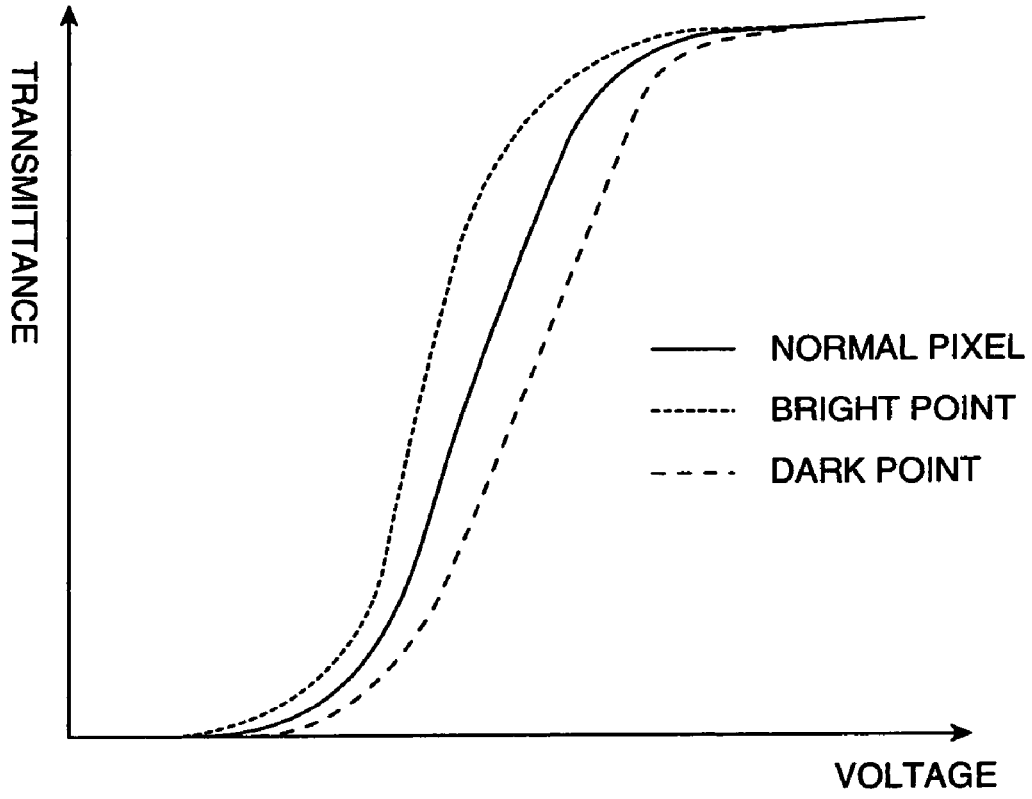
FIG. 4 is a schematic of a display result obtained when a defective pixel exists in a G panel module of FIG. 2.

Simply described, a defective pixel of a liquid crystal display panel refers to a pixel that is different from a normal pixel in the voltage-transmittance characteristic, as shown in FIG. 4. In a normally black mode of a liquid crystal, the defective pixel becomes a bright point when the characteristic of the defective pixel distributes above that of the normal pixel, whereas the defective pixel becomes a dark point when the characteristic of the defective pixel distributes below that of the normal pixel. Therefore, in the related art example, the projected image is displayed with a different γ characteristic in the defective pixel so that the transmittance of the defective pixel matches that of the normal pixel.

However, when the correction is made only by modifying the γ characteristic of the defective pixel, it may be difficult to accurately match the gradation display of the defective pixel with that of the normal pixel throughout all gradation values. Further, particularly in a dark portion and a bright portion, the transmittance of the defective pixel sometimes cannot be corrected within the working voltage range of the normal pixel. Therefore, in the related art, the mechanism of imparting a wide voltage range to the defective pixel is prepared to make the correction. In this case, however, a mechanism to apply a higher voltage than normal is required in terms of hardware, thus causing increased costs.

Figure 5:
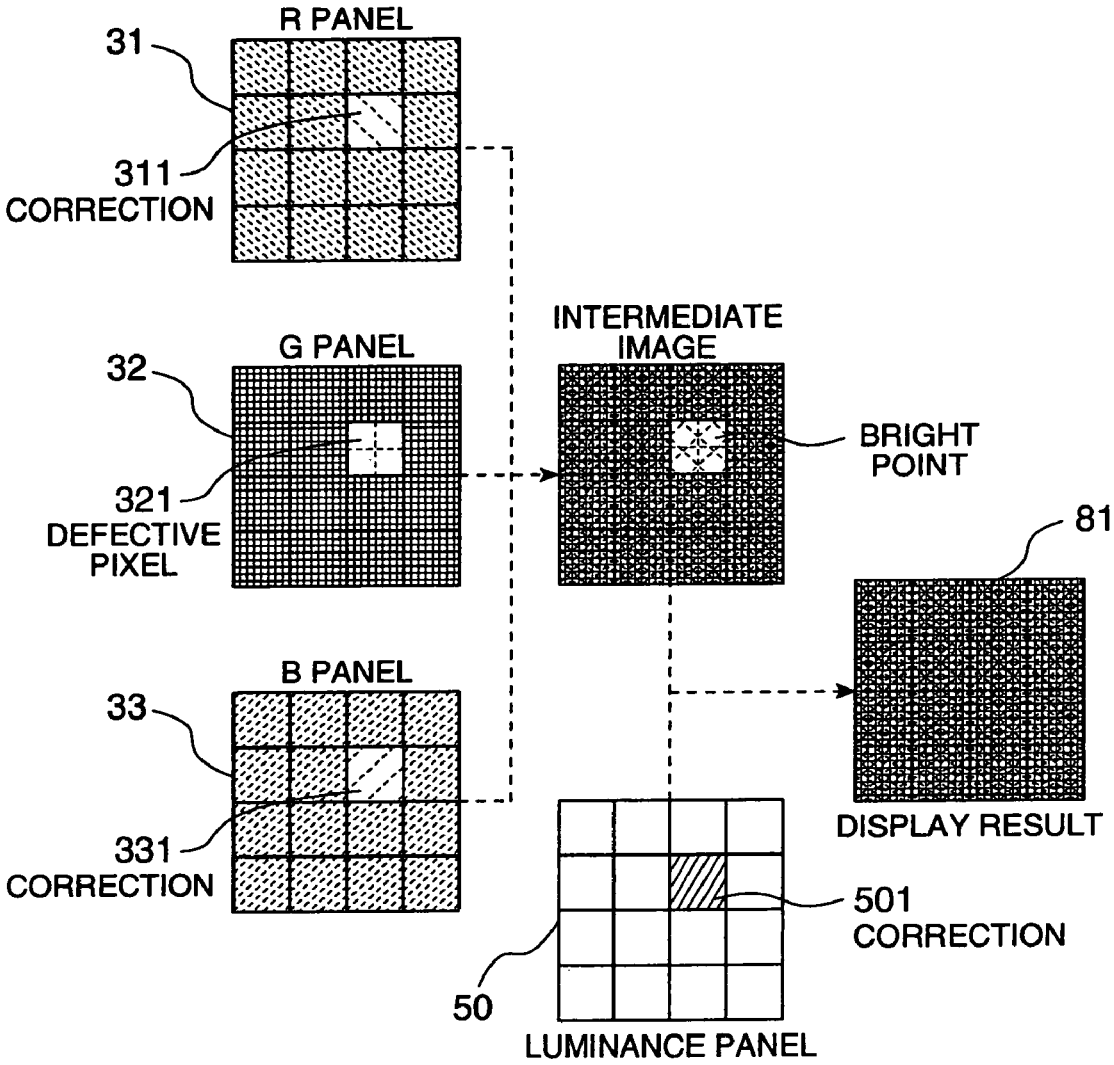
FIG. 5 is a schematic example of correcting the defective pixel of FIG. 4 according to the schematic of FIG. 1.

Therefore, this exemplary embodiment is configured such that the defective pixel is corrected by the correction method as shown in FIG. 5. In the double-modulation system configuration shown in FIG. 2, when a defective pixel 321 exists in the G panel module 32 of the upstream stage as shown in FIG. 5, a pixel of the luminance panel module 50 of the downstream stage, which optically corresponds to the defective pixel 321 of the G panel module 32, is adjusted in response to the defect characteristic, thus making the correction. That is, the luminance of a pixel 501 of the luminance panel module 50, which corresponds to the defective pixel 321 displayed bright, is corrected to become dark with a predetermined characteristic.

However, in this hardware configuration, the correction cannot be satisfactorily made by adjusting only the luminance panel module 50. A satisfactory correction may be achieved by also correcting the values of pixels 311 and 331 of the R and B panel modules 31 and 33, which correspond to the defective pixel 321 of the G panel module 32, in response to the defect characteristic. More specifically, assume that, in a certain gradation, the defective pixel 321 of the G panel module 32 is 5% brighter than the normal pixel. In this case, the values of the corresponding pixels 311 and 331 of the R and B panel modules 32 and 33 are also brightened by 5%. However, the value of the corresponding pixel 501 of the luminance panel module 50 is darkened by 5%. This makes it possible to obtain a uniform gray display 81 having the defect corrected as shown in FIG. 5. Further, the process can be performed process-wise in quite the same manner even if the anteroposterior relationship between a luminance panel (the luminance panel module 50) and color panels (the R, G, and B panel modules 31, 32 and 33) is reversed in the hardware configuration.

The adjustment of the pixel values can be carried out by two methods. The first method is that, similar to the related art example, a γ curve of each pixel corresponding to the defective pixel is set in response to the defect characteristic. That is, plural kinds of correction tables are pre-stored in, for example, each of the panel γ table storage sections 105 to 108 of FIG. 1. Then, when a pixel to be corrected is driven based on an image signal responsive to the pixel, a correction table is selected using a γ table selection signal inputted in synchronism with the image signal, thus adjusting a drive signal. This method facilitates a hardware process, so that an increase in process speed can be expected. Further, in terms of correction accuracy, the correction is made with very high accuracy since the correction is made by double modulation, unlike the related art example. Thus, it is highly possible that the same gradation as that of the surrounding normal pixels can be expressed.

The second method is that the process is performed only by setting an image value inputted. For example, similar to the defect correction data storage section 103 of FIG. 1, information to specify the defective pixel is pre-stored in a predetermined storage section. And, the information is supplied to an external signal processor such as a personal computer. Then, based on the supplied information, the external signal processor corrects the values of the other pixels that correspond to the defective pixel, thus generating RGBL signals (pixel values including RGB signals and a luminance signal). The pixels are controlled based on these signals, thereby making it possible in the display control apparatus to omit the correction process based on the defective pixel. This method enables a software process, which provides a low cost and a high degree of freedom. A process performed by this method, for example, is described as follows. When uniform deep gray is displayed (it is assumed that the display result 81 is in a gray display state) as in the example of FIG. 5, if RGB of the color panels=(32, 32, 32) and L of the luminance panel=255 in the normal pixel portion, the defect portion is set such that RGB=(48, 32, 48) and L of the luminance panel=240, thereby enabling the correction. In the case of this method, for example, even if the γ characteristics of the normal pixels are varied in various ways, it can be responded only by setting the pixel values, which provides low cost and a high degree of freedom.

Figure 6:
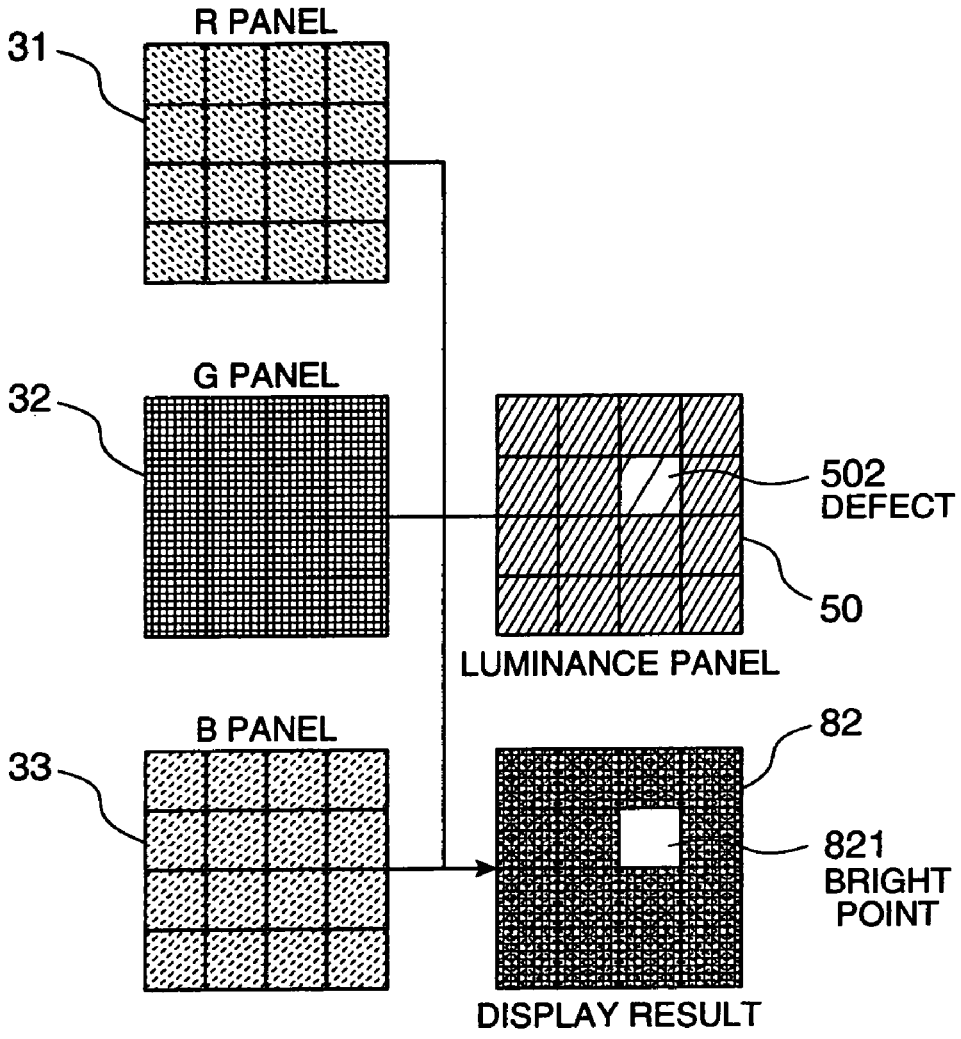
FIG. 6 is a schematic of a display result obtained when a defective pixel exists in a luminance module of FIG. 2.
Figure 7:
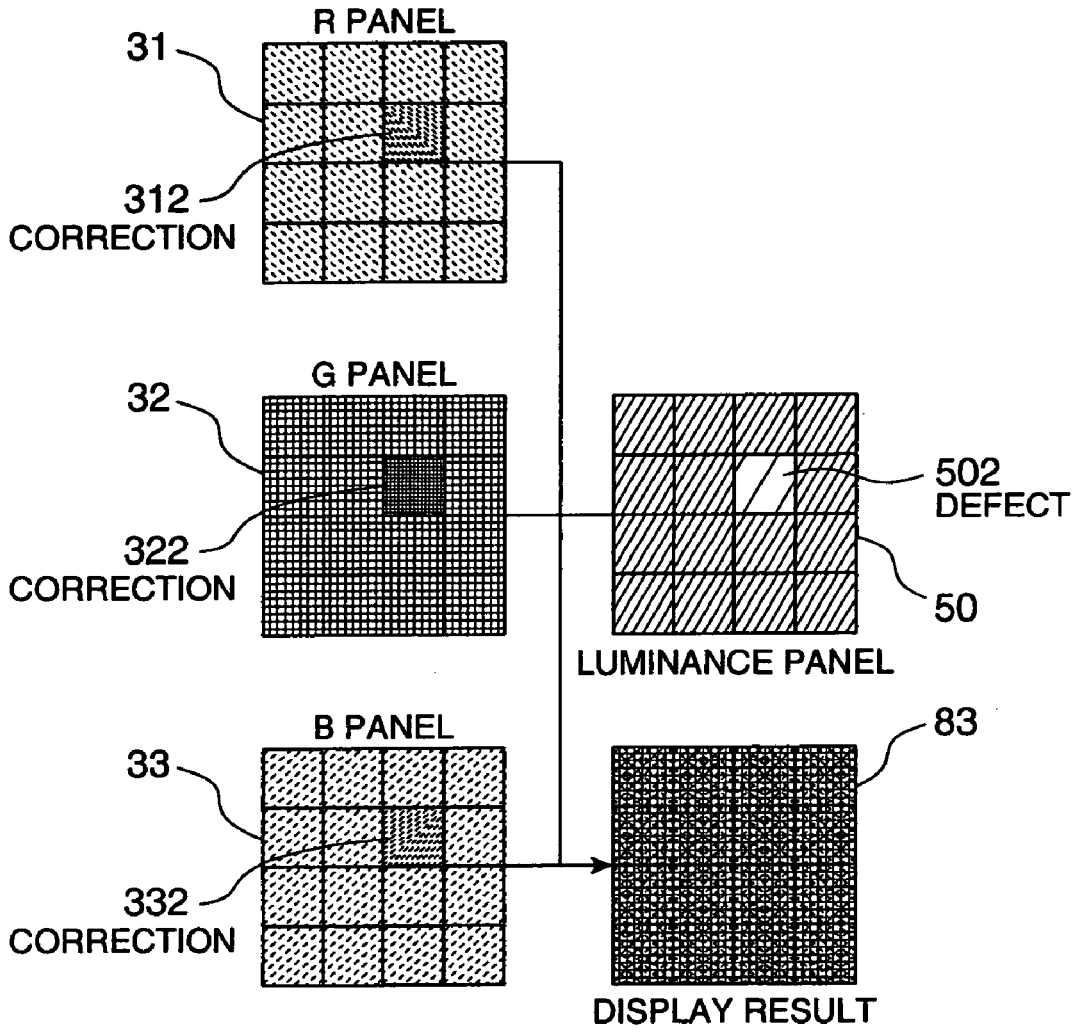
FIG. 7 is a schematic example of correcting the defective pixel of FIG. 6 according to the schematic of FIG. 1.

An example of the correction made when a defective pixel exists on the luminance panel side will now be described using FIGS. 6 to 7. As shown in FIG. 6, when no correction is made, a bright point 821 is displayed in a display result 82 on a projection surface when a defective pixel 502 exists in the luminance panel module 50. In this case, in this exemplary embodiment, as shown in FIG. 7, corresponding pixels 312, 322, and 332 of three color panels (R panel module 31, G panel module 32, and B panel module 33) are adjusted to be somewhat dark, thereby enabling the correction. Thus, a corrected display result 83 can be obtained.

An example of the correction process performed when the two modulation systems have different resolutions will now be described using FIGS. 8 to 13.

Figure 8:
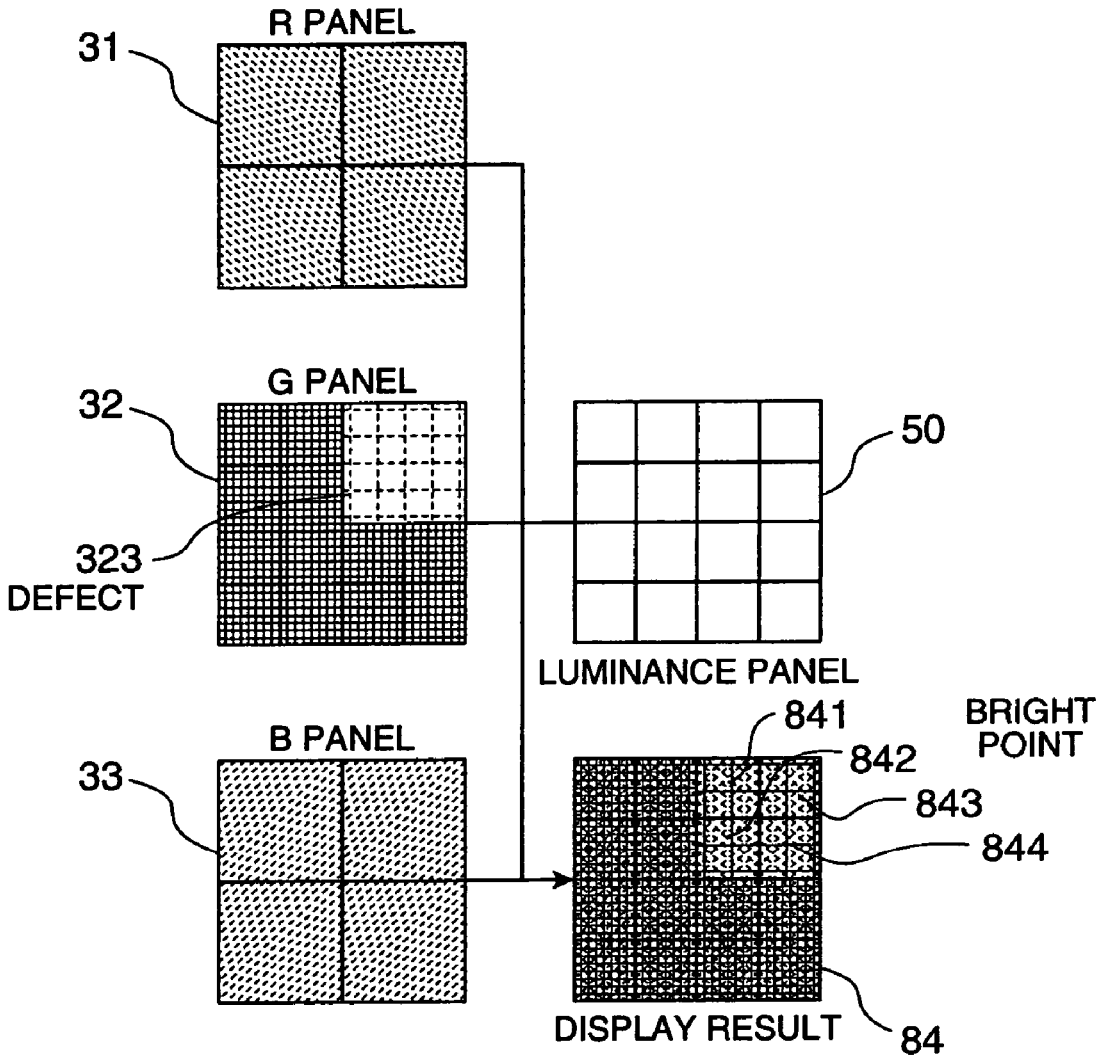
FIG. 8 is a schematic of a display result obtained when a defective pixel exists in the G panel module when color panels and the luminance panel are different in resolution.
Figure 9:
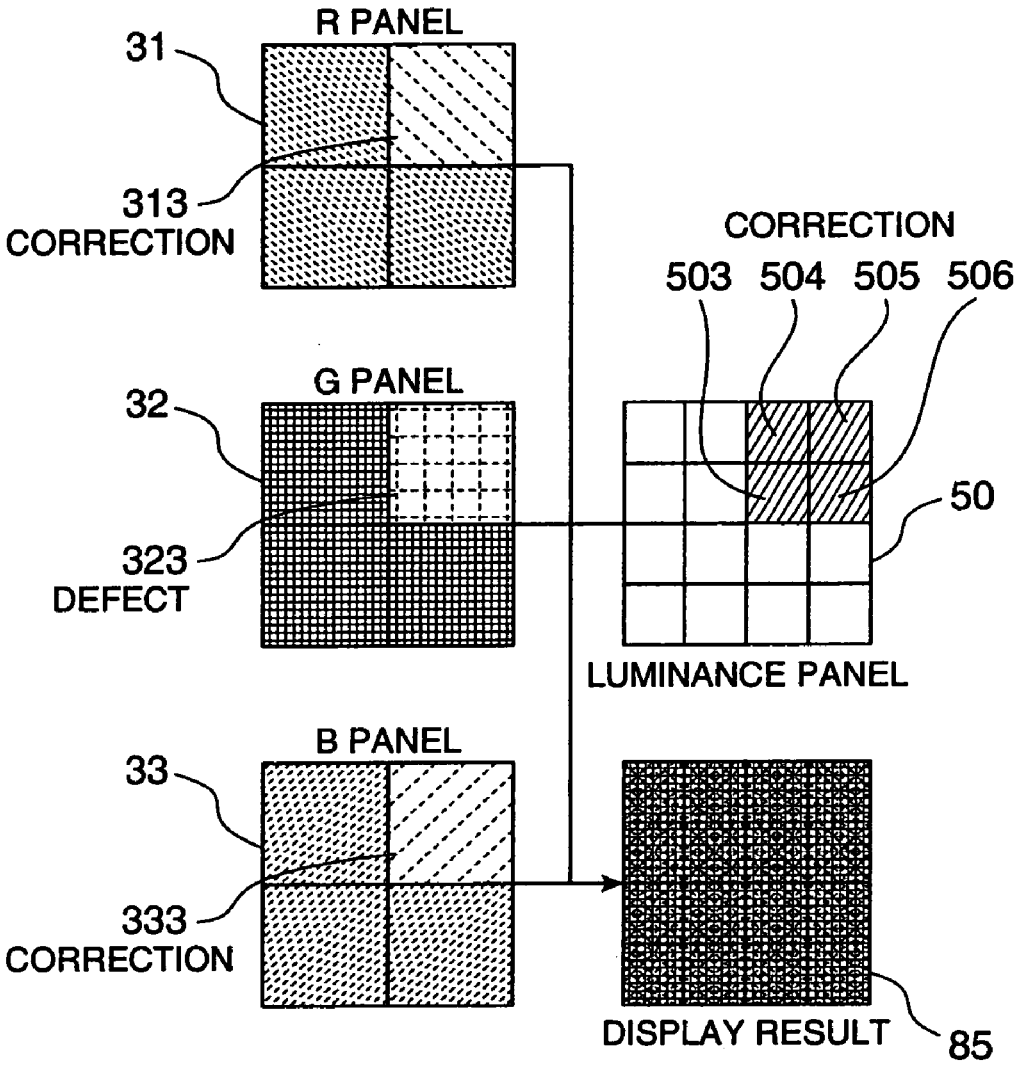
FIG. 9 is a schematic example of correcting the defective pixel of FIG. 8 according to the schematic of FIG. 1.

FIG. 8 is an example in which the horizontal and vertical resolution of the luminance panel module 50 is a multiple of each of the horizontal and vertical resolutions of the color panels (R panel module 31, G panel module 32, and B panel module 33) (i.e., four pixels of the luminance panel correspond to one pixel of each of the color panels). In this example, a defective pixel 323 exists in the G panel module 32 of the color panel, and when no correction is made, bright green points 841 to 844, which are equivalent to the four pixels and have the resolution of the luminance panel module 50, occur in a display result 84. Therefore, in this exemplary embodiment, as shown in FIG. 9, corresponding pixels 313 and 333 of the R and B panel modules 31 and 33 are adjusted to be somewhat bright, and four corresponding pixels 503 to 506 of the luminance panel module 50 are adjusted to be somewhat dark. Thereby, a corrected uniform gray display 85 can be obtained.

Figure 10:
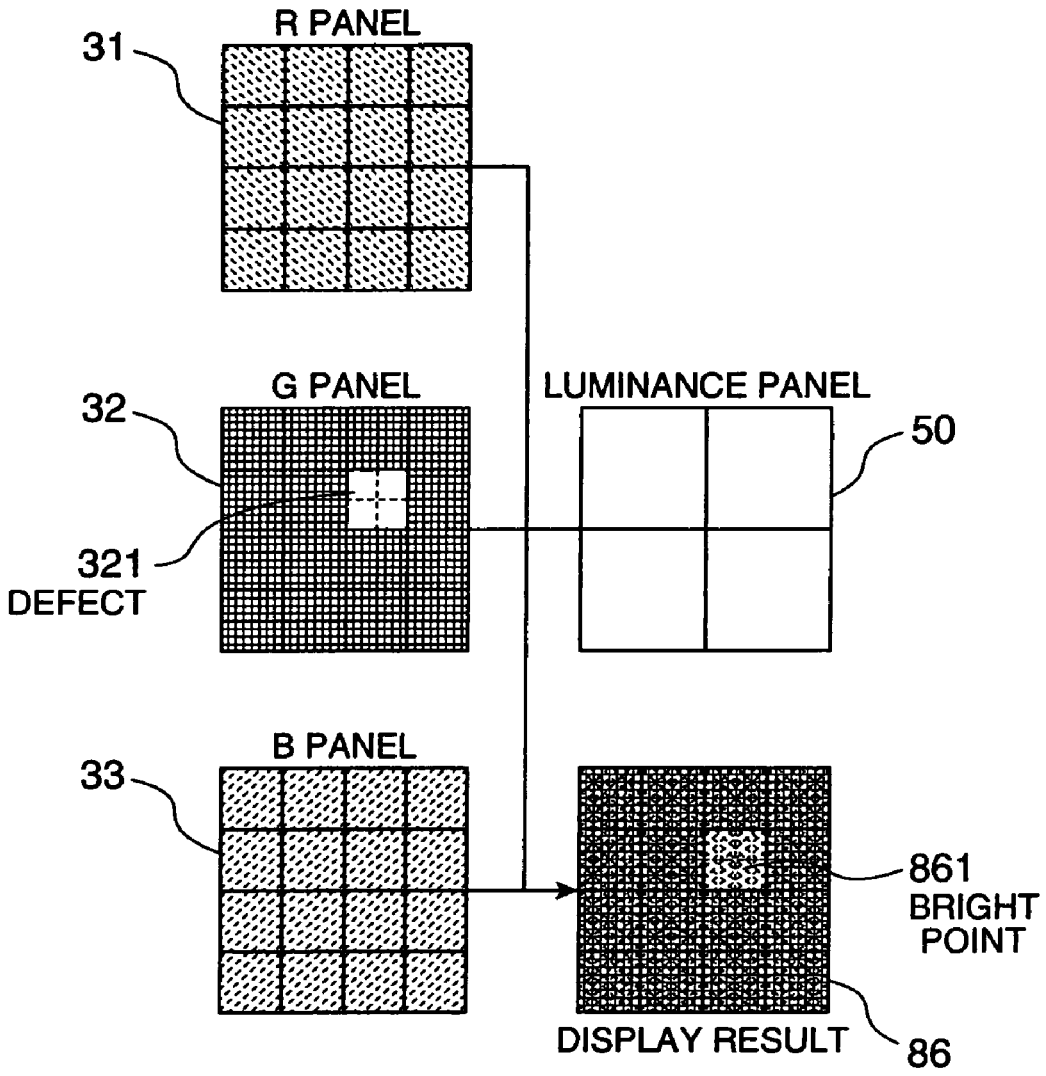
FIG. 10 is a schematic of a display result obtained when a defective pixel exists in the luminance panel module when the color panels and the luminance panel are different in resolution.
Figure 11:
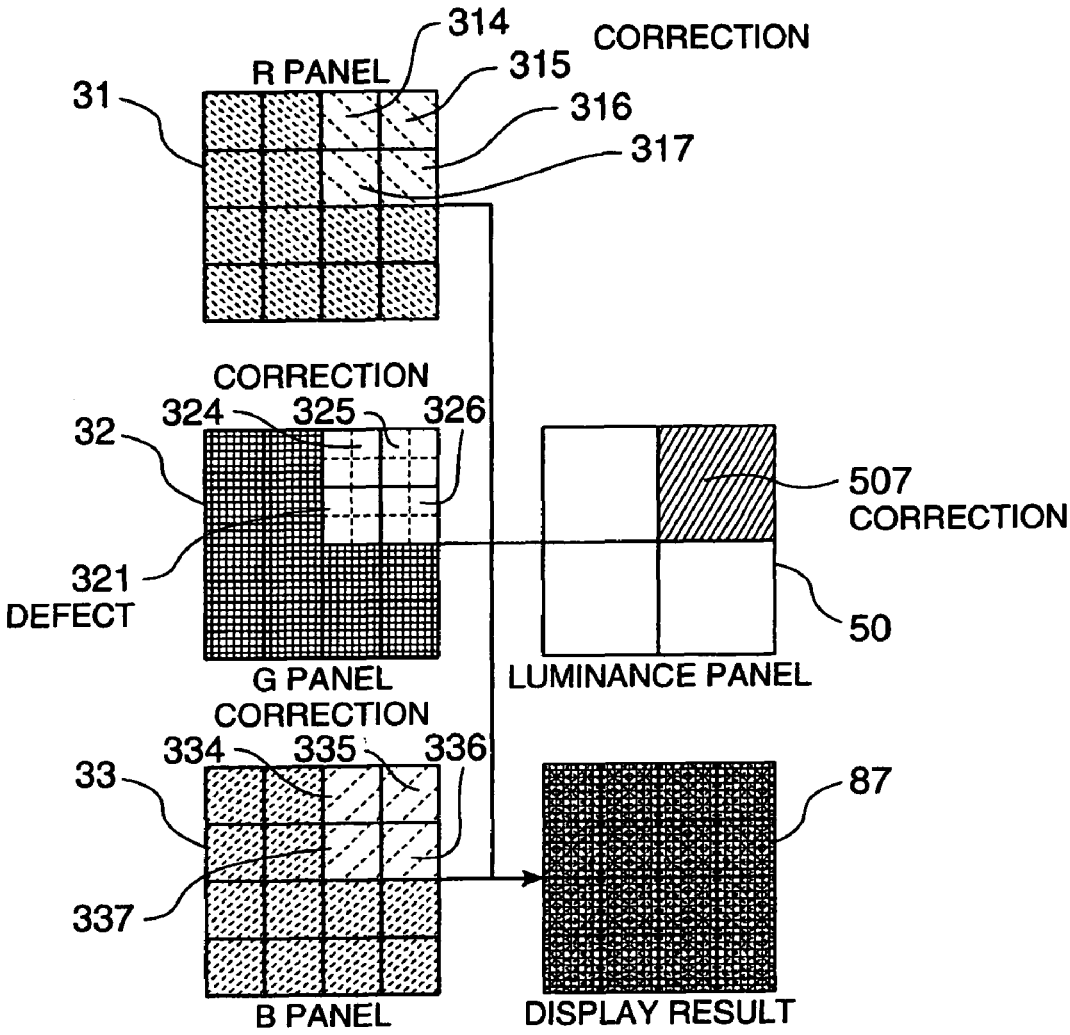
FIG. 11 is a schematic of an example of correcting the defective pixel of FIG. 10 according to the schematic of FIG. 1.

Next, FIG. 10 is an example in which, conversely, the horizontal and vertical resolutions of the color panels (R panel module 31, G panel module 32, and B panel module 33) are each a multiple of the horizontal and vertical resolution of the luminance panel module 50 (i.e., four pixels of each of the color panels correspond to one pixel of the luminance panel). In this example, a defective pixel 321 exists in the G panel module 32 of the color panel, and when no correction is made, a bright green point 861, which is equivalent to the one pixel and has the resolution of the color panel, occurs as a display result 86. Therefore, in this exemplary embodiment, as shown in FIG. 11, pixels 317 and 337 of the R and B panel modules 31 and 33, which correspond to the defective pixel 321, and the remaining adjacent three pixels of each of R, G, and B (i.e., pixels 314 to 316, pixels 324 to 326, and pixels 334 to 336), which correspond to a pixel 507 of the luminance panel module 50, which corresponds to the defective pixel 321, are adjusted to be somewhat bright. And, the corresponding pixel 507 of the luminance panel module 50 is adjusted to be somewhat dark. Thereby, a corrected uniform gray display 87 can be obtained.

Figure 12:
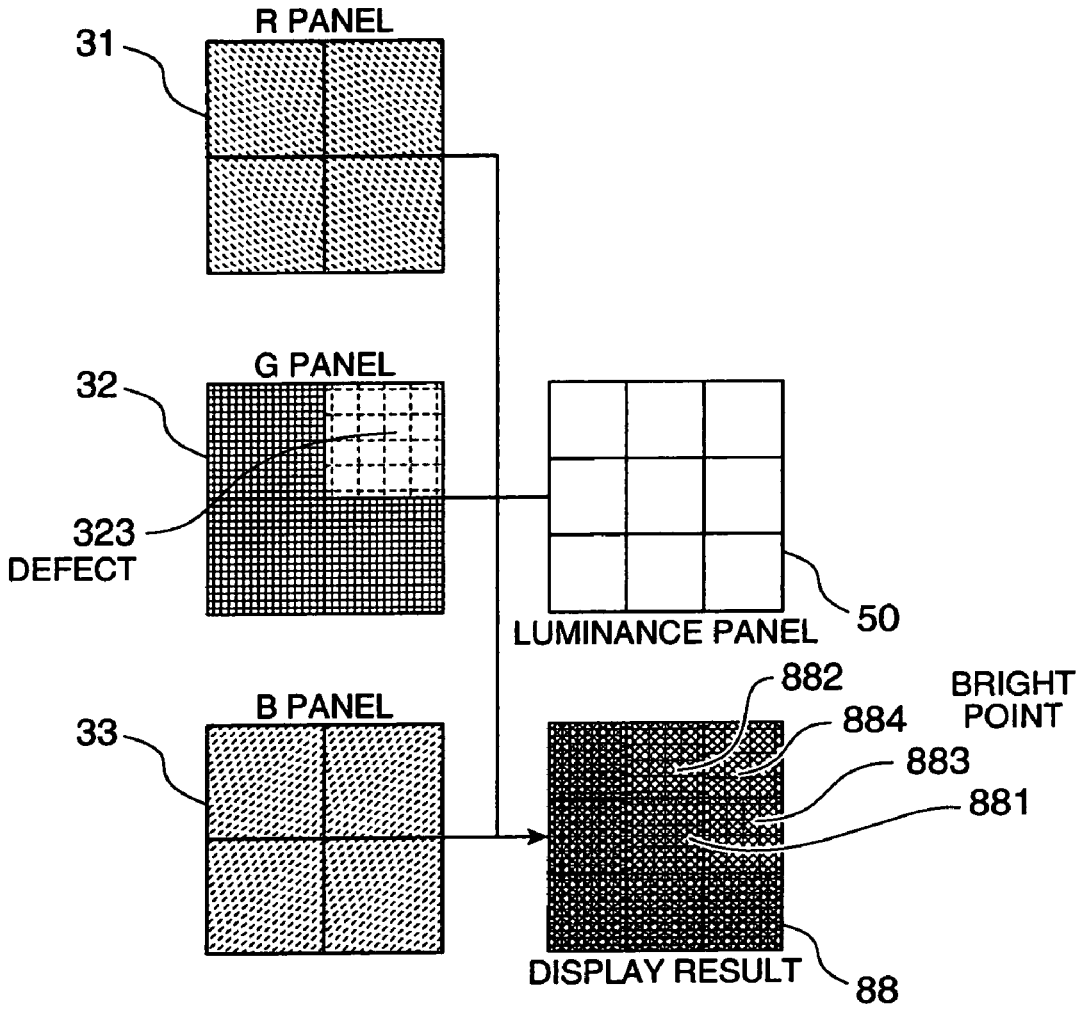
FIG. 12 is a schematic of a display result obtained when a defective pixel exists in the G panel module when the color panels and the luminance panel are different in resolution (are not in a multiple relationship) in an exemplary embodiment of the invention.
Figure 13:
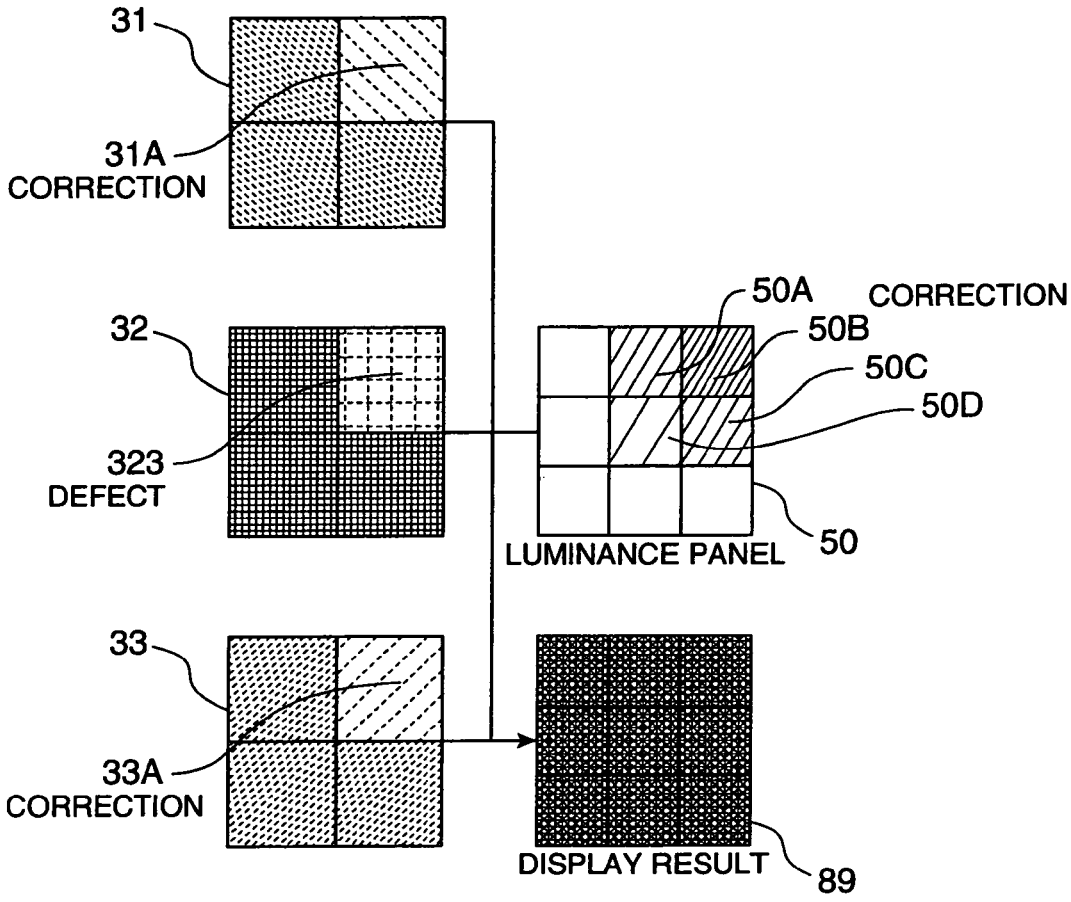
FIG. 13 is a schematic example of correcting the defective pixel of FIG. 12 according to the schematic of FIG. 1.

An example, in which the resolution of each of the color panels and that of the luminance panel are not in the multiple relationship to each other unlike in FIGS. 9, 10, and 11, will now be described using FIGS. 12 to 13. FIG. 12 is an example in which nine pixels of the luminance panel correspond to four pixels of each of the color panels. In this example, a defective pixel 323 exists in the G panel module 32 and, when no correction is made, the following bright green points occur in respective pixels (as a display result 88) as based on the resolution of the luminance panel module 50. That is, the brightest bright green point occurs in an upper right pixel 884, the second brightest bright green points occur in a pixel 882 to the left of the pixel 884 and a pixel 883 below the pixel 884, respectively, and the darkest bright green point occurs in a diagonally lower left pixel 881. The reason for such differences in brightness of the bright points, as based on the resolution of the luminance panel module 50, follow. That is, the upper right pixel 884 has an area ratio of 100% relative to the defective pixel 323, the pixel 882 to the left of the pixel 884 and the pixel 883 below the pixel 884 have an area ratio of 50% relative to the defective pixel 323, and the diagonally lower left pixel 881 has an area ratio of 25% relative to the defective pixel 323. Thus, the bright points also vary in brightness according to the difference in area ratio. Therefore, as shown in FIG. 13, the correction is made, assuming that an improvement in luminance of the defect is 4%, in the following described manner. That is, first, corresponding pixels 31A and 33A of the R and B panel modules 31 and 33 are brightened by 4%, and an upper right pixel 50B of the luminance panel module 50 is darkened by 4%. Then, a pixel 50A to the left of the pixel 50B and a pixel 50C below the pixel 50B are darkened by 2%, and a diagonally lower left pixel 50D is darkened by 1%. Thereby, a uniform gray correction display result 89 can be obtained. That is, the pixel values of panels without any defective pixels are adjusted according to an average of the pixel values and further to a weighted average obtained by multiplying the pixel value average by a predetermined coefficient. Thereby, the correction can be made with high accuracy even when the resolutions are different from each other.

An example of the correction made when the color panels and the luminance panel are different in configuration from those shown in FIG. 2 will now be described using FIGS. 14 to 15.

Figure 14:
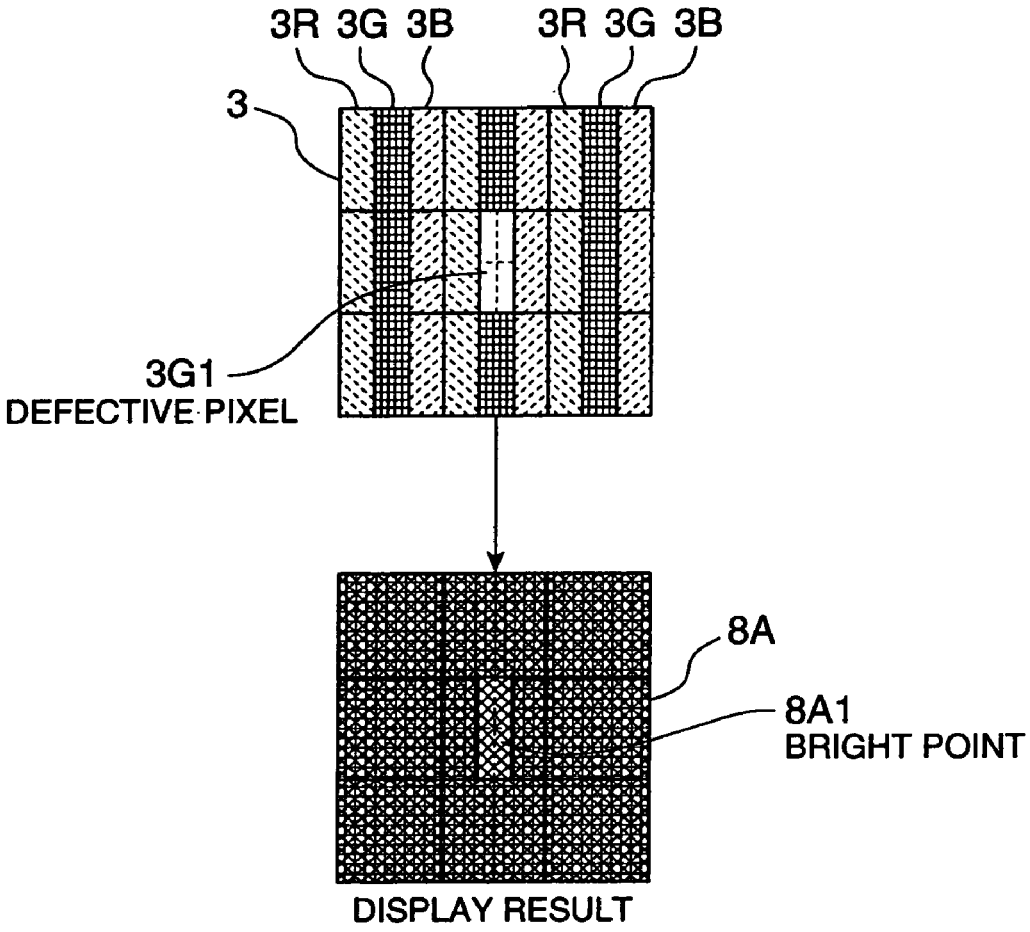
FIG. 14 is a schematic of a defective pixel and its display example of when a 1-LCD color panel is used in an exemplary embodiment of the invention.
Figure 15:
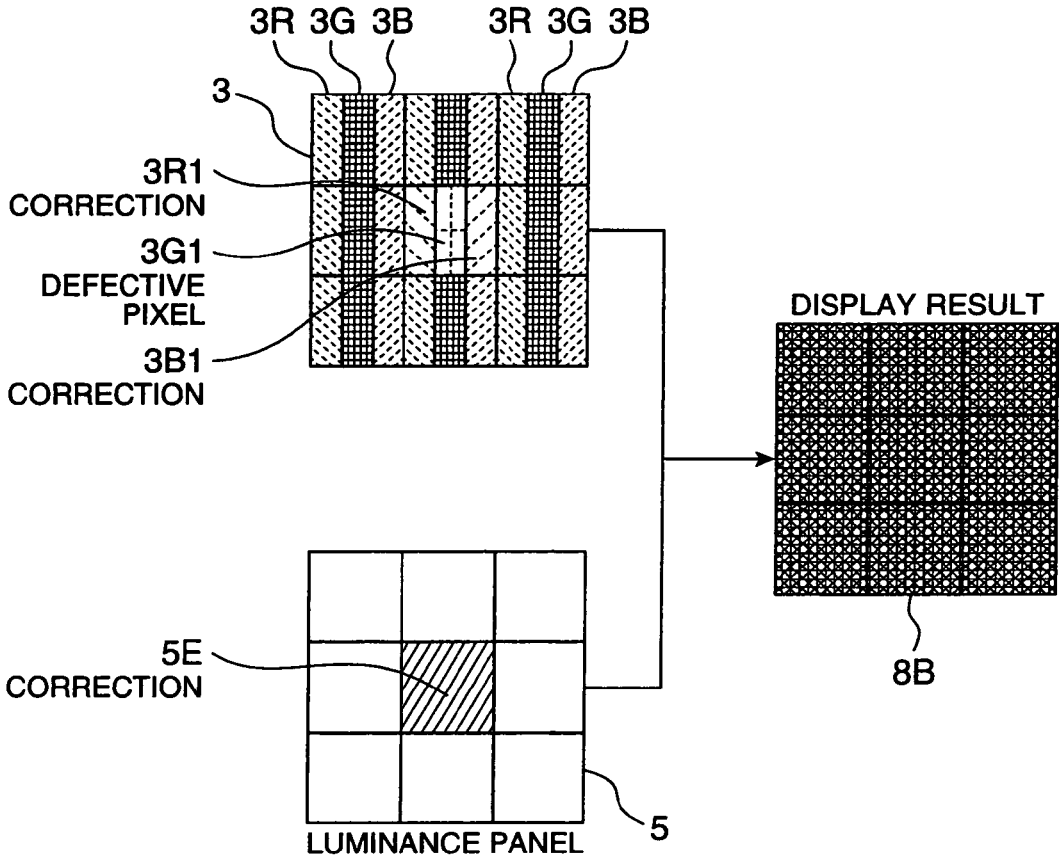
FIG. 15 is a schematic example of correcting the defective pixel of FIG. 14 according to an exemplary embodiment of the invention.

FIGS. 14 to 15 are schematic examples of the correction made when the color panel is configured as a 1-LCD color panel 3 using color filters of three colors of R, G, and B and the luminance panel is configured as a 1-LCD luminance panel 5. In this case, as shown in FIG. 14, the color panel 3 is configured by arraying a plurality of each of the R, G, and B color filters 3R, 3G, and 3B and superposing a plurality of sub-pixels on the respective filters 3R, 3G, and 3B. In the example shown in FIG. 14, a defective pixel 3G1 exists in the G sub-pixel of the color panel 3, and a bright green point 8A1 occurs as shown in a display result 8A. In this case, in the display control apparatus of the exemplary embodiments, as shown in FIG. 15, the R sub-pixel 3R1 and B sub-pixel 3B1 adjacent to the G sub-pixel 3G1 are adjusted to be bright in conformity with the defect of the G sub-pixel 3G1. And, a corresponding pixel 5E of the luminance panel 5 is adjusted to be somewhat dark. Thereby, a corrected uniform gray display 8B can be obtained.

Figure 16:
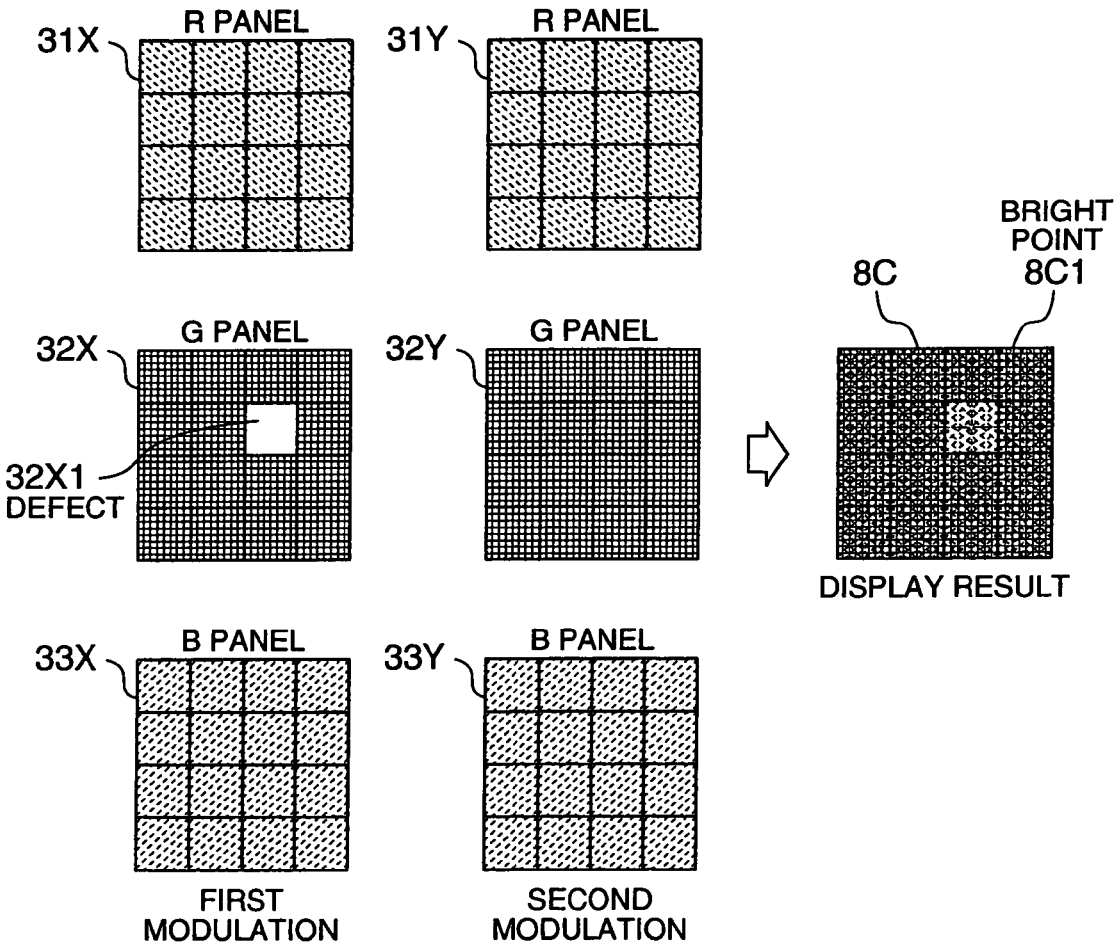
FIG. 16 is a schematic of a defective pixel and its display example of when a pair of color panels are used as two modulation systems.
Figure 17:
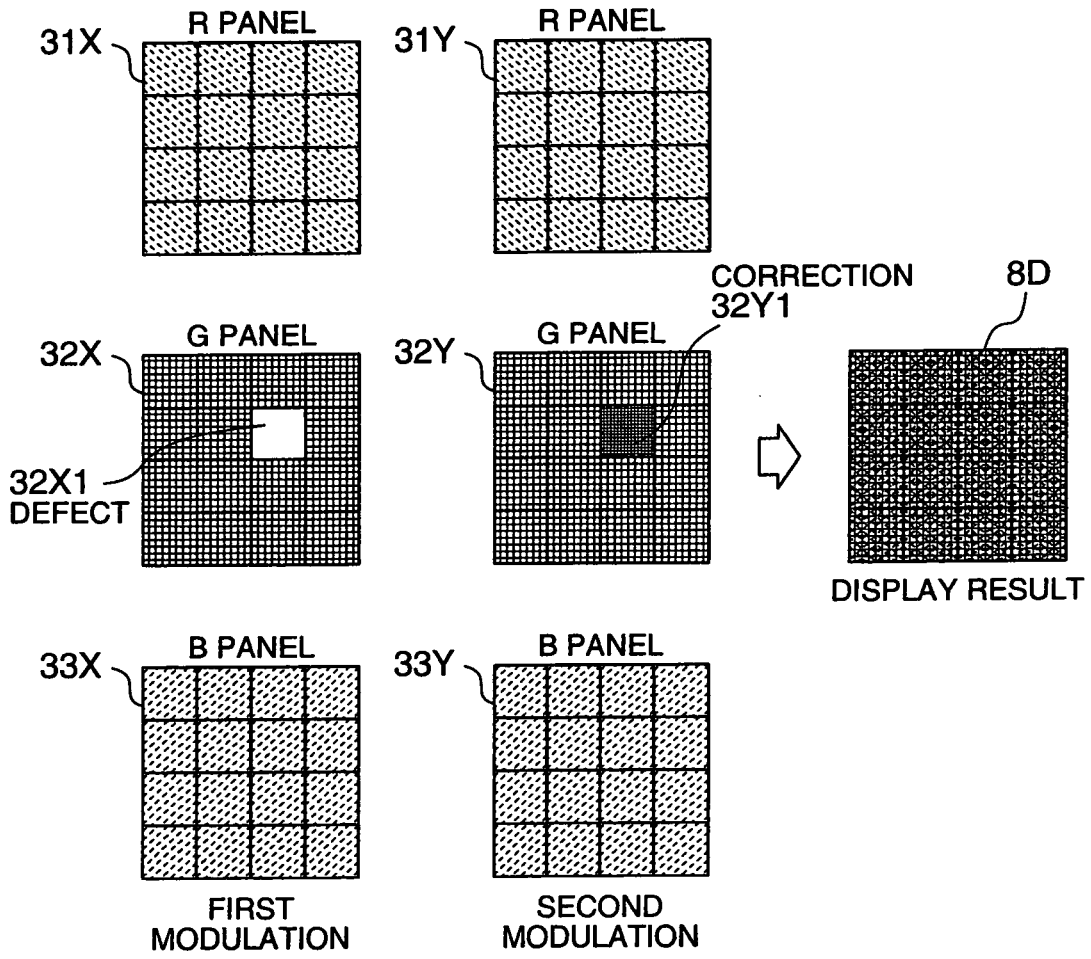
FIG. 17 is a schematic example of correcting the defective pixel of FIG. 16 according to an exemplary embodiment of the invention.

An example of the correction made when the double-modulation system configuration is of 3-LCD color panels+3-LCD color panels will now be described using FIGS. 16 to 17. The color panels of each set are optically disposed in series, and the two sets of color panels configure first and second modulation elements. The first modulation element includes an R panel module 31X, a G panel module 32X, and B panel module 33X, and the second modulation element includes an R panel module 31Y, a G panel module 32Y, and B panel module 33Y. As shown in FIG. 16, when no correction is made, for example, a bright green point 8C1 is displayed as a display result 8C when a defective pixel 32X1 exists in the G panel 32X on the first modulation element side. In this case, when the correction is made by the display control apparatus of the exemplary embodiments, as shown in FIG. 17, a corresponding pixel 32Y1 of the G panel 32Y on the second modulation element side is adjusted to be somewhat dark. Thereby, a corrected uniform gray display 8D can be obtained.

Other various configurations can be considered for use in hardware and resolution and can be similarly processed. Only the bright point correction examples have been described, but it is apparent that the dark point can also be similarly processed. Only the G pixel and the luminance pixel have been described as to the defective pixel, but it is apparent that the R pixel, the B pixel, etc. can also be similarly processed. Further, when the luminance panel or the color panels are used as the first or second (or second or first) modulation panel section, it follows that the aforesaid exemplary embodiment has described the case in which any one of the first and second modulation sections has a defect. However, even when both the first and second modulation sections each have a defect, the defect correction can be made unless the positions of the defects overlap each other. Further, the aforesaid exemplary embodiment has shown the mode in which a transmission liquid crystal panel is used as the modulation panel section. Otherwise, the modulation panel section can use a DMD (Digital Micromirror Device), a GLV® (Grating Light Valve) (registered trademark owned by Silicon Light Machines Corporation California), an LCOS (liquid Crystal on Silicon), and a modulated light source (an LED (Light Emitting Diode), an OLED (Organic Light Emitting Diode), a laser light source, etc.).

In addition, to correct a dark point occurring as a defect in the case of a white display (the brightest state) or a bright point occurring as a defect in the case of a black display (the darkest state), the defect correction can be made by slightly reducing the value of white or black displayed by the display device (i.e., the white is slightly darkened and the black is slightly brightened) (because it is impossible in the second modulation panel section to display a pixel brighter than in the brightest state or a pixel darker than in the darkest state). Specifically, in the second modulation panel section, a pixel corresponding to the defective pixel of the first modulation panel section is not corrected, but the other pixels (pixels corresponding to the normal pixels of the first modulation panel section) are corrected, thereby enabling the defect correction. In other words, a modulation range of the second modulation section in a portion corresponding to the normal pixels is slightly narrowed. To give a numeric example, assuming that a defective pixel (dark point) exists in the first modulation panel, the pixel is made the brightest (255 as 8-bit input), and the value of the second modulation panel section is made the brightest (255), thus obtaining a first brightness. Further, the normal pixels of the first modulation panel section are made the brightest (255), and the modulated pixels of the second modulation panel section are made slightly darker (242), thus obtaining a second brightness. In this case, when the first brightness is the same as the second brightness, a modulation range of the second modulation panel section, which corresponds to the normal pixels, need only be controlled within a range of 0 to 242. Additionally, when the defect correction is made as aforesaid, a dynamic range is reduced to some extent. However, such a reduction affects image quality less than as compared with a normal LCD (Liquid Crystal Display), etc. since an HDR display (double-modulation display) originally has a very wide dynamic range.

As above, according to the exemplary embodiments of the invention, the two modulation elements are configured by combining the panels optically disposed in series, such as the color panels (upstream stage)+the color panels (downstream stage), the luminance panel (upstream stage)+the color panels (downstream stage), and the color panels (upstream stage)+the luminance panel (downstream stage). In this case, pixels, which panels without any defective pixels have at a position corresponding to a defective pixel, are adjusted in response to the defect, thereby enabling a fine defect correction. In this case, the color panels and the luminance panel may be configured to be of 1-LCD type and may also be configured to be of 3-LCD type.

What is claimed is:

1. A display control apparatus that controls first and second modulation sections optically connected in series, the display control apparatus comprising:

a storage unit that stores information to specify a defective pixel of the first modulation section; and a control unit that controls the second modulation section in response to a defect of the defective pixel being stored in the storage unit, the second modulation section including at least one of a plurality of color panels and a luminance panel, wherein the control unit varies the amount of control responsive to the defective pixel step by step in response to the positional relationship between the defective pixel of the first modulation section and a plurality of pixels of the at least one of the plurality of color panels and the luminance panel, and controls the plurality of pixels which the second modulation section has at a position corresponding to the defective pixel being stored in the storage unit and at positions adjacent to the corresponding position, and a state of the defective pixel is not changed prior to or during the compensation;

the first modulation section including three panels respectively corresponding to different colors;

the second modulation section includes the luminance panel module modulating the luminances of all wavelength ranges; and pixels corresponding to the defective pixel included in non-defective panels and the luminance panel compensate for the defective pixel by an amount of compensation determined according to an amount of defect.

2. The display control apparatus according to claim 1, the control unit controlling a pixel in response to the defect, the second modulation section having the pixel at a position corresponding to the defective pixel being stored in the storage unit, the control unit further controlling pixels in response to the defect, two out of the three panels of the first modulation section not having the defective pixel and having the pixels at positions corresponding to the defective pixel.

3. The display control apparatus according to claim 1, the control unit performing pixel control responsive to the defect by modifying a gamma setting.

4. The display control apparatus according to claim 1, the control unit performing pixel control responsive to the defect upon input of a pixel value adjusted in response to the information stored in the storage unit.

5. A display control method of controlling first and second modulation sections optically connected in series, the method comprising:

using a storage unit that stores information to specify a defective pixel of the first modulation section;

controlling the second modulation section in response to a defect of the defective pixel being stored in the storage unit, the second modulation section including at least one of a plurality of color panels and a luminance panel; and varying the amount of controlling responsive to the defective pixel step by step in response to the positional relationship between the defective pixel of the first modulation section and a plurality of pixels of the at least one of the plurality of color panels and the luminance panel, and controlling the plurality of pixels which the second modulation section has at a position corresponding to the defective pixel being stored in the storage unit and at positions adjacent to the corresponding position, wherein a state of the defective pixel is not changed prior to or during the compensation;

the first modulation section including three panels respectively corresponding to different colors;

the second modulation section includes the luminance panel module modulating the luminances of all wavelength ranges; and pixels corresponding to the defective pixel included in non-defective panels and the luminance panel compensate for the defective pixel by an amount of compensation determined according to an amount of defect.

6. The display apparatus according to claim 1, wherein the second modulation section corrects a brighter than normal defect of the first modulation section by decreasing a brightness that is controlled by the second modulation section.

7. The display apparatus according to claim 1, wherein the second modulation section corrects a darker than normal defect of the first modulation section by increasing a brightness that is controlled by the second modulation section.

8. The display apparatus according to claim 1, wherein a brightness, which is output by the luminance panel of the second modulation section, is varied to correct for defects in the first modulation section.

9. The display control method according to claim 5, wherein the second modulation section corrects a brighter than normal defect of the first modulation section by decreasing a brightness that is controlled by the second modulation section.

10. The display control method according to claim 5, wherein the second modulation section corrects a darker than normal defect of the first modulation section by increasing a brightness that is controlled by the second modulation section.

11. The display control method according to claim 5, wherein a brightness, which is output by the luminance panel of the second modulation section, is varied to correct for defects in the first modulation section.

* * * * *